US006075547A

United States Patent [19]

Takeuchi

[11] Patent Number: 6,075,547

[45] Date of Patent: Jun. 13, 2000

[54] COLOR IMAGE FORMING APPARATUS FOR PREVENTING TONER IMAGE DISPLACEMENT ON AN IMAGE SUPPORT

[75] Inventor: Hiroaki Takeuchi, Chiba, Japan

[73] Assignee: Ricoh Company, Ltd., Tokyo, Japan

[21] Appl. No.: 09/074,370

[22] Filed: May 8, 1998

[30] Foreign Application Priority Data

May 13, 1997 [JP] Japan ..... 9-122569
Apr. 27, 1998 [JP] Japan ..... 10-116640

[51] Int. Cl.[7] ..... B41J 2/455; B41J 2/525

[52] U.S. Cl. ..... 347/116; 347/232; 347/250

[58] Field of Search ..... 347/116, 232, 347/250; 399/205, 301

[56] References Cited

U.S. PATENT DOCUMENTS

| | | | |
|---|---|---|---|
| 5,737,003 | 4/1998 | Moe et al. | 347/116 |
| 5,765,083 | 6/1998 | Shinohara | 399/301 |
| 5,905,519 | 5/1999 | Brenner et al. | 347/116 |
| 5,978,003 | 11/1999 | Brenner | 347/116 |

FOREIGN PATENT DOCUMENTS 198 08 507 9/1998 Germany .

9-106129 4/1997 Japan .

*Primary Examiner*—Richard Moses
*Attorney, Agent, or Firm*—Oblon, Spivak, McClelland, Maier & Neustadt, P.C.

[57] ABSTRACT

A color image forming apparatus includes an image forming unit which forms a multicolor image on a second image support by sequentially transferring toner images related to a plurality of colors from a first image support to the second image support in an overlaying manner. A reference position detecting unit detects a reference mark signal every time a reference mark at a reference position on the second image support is sensed during rotation of the second image support. A laser scan start timing control unit controls a laser scan start timing for the image forming unit to start scanning the first image support by a laser beam, based on the reference mark signal. A phase error measurement unit measures a phase error between a line sync signal and the reference mark signal by counting system clocks before the laser scan start timing. A drive speed control unit adjusts a rotating speed of the second image support to a controlled speed by outputting a drive pulse to a motor which rotates the second image support, the drive speed control unit determining an ON-state period of the drive pulse depending on the phase error measurement such that a timing of detection of the reference mark signal matches the laser scan start timing.

8 Claims, 10 Drawing Sheets

COLOR IMAGE FORMING APPARATUS FOR PREVENTING TONER IMAGE DISPLACEMENT ON AN IMAGE SUPPORT

BACKGROUND OF THE INVENTION (1) Field of the Invention

The present invention generally relates to a color image forming system utilizing an electrophotographic method, such as a color copier, a color printer or a color facsimile, and more particularly to a color image forming system in which toner images related to a plurality of colors are sequentially transferred from a photoconductive medium to an intermediate transfer belt in an overlaying manner, and a multicolor image on the intermediate transfer belt is transferred to a recording material.

(2) Description of the Related Art

In a color image forming system, a photoconductive medium serving as an image support is rotated and the photoconductive medium surface is charged by a charger. A laser scan unit scans the charged surface of the photoconductive medium by a laser beam which is turned ON/OFF depending on a color-separated image signal. The color-separated image signal is generated with respect to each of secondary colors, such as yellow, cyan and magenta. The laser scan unit sequentially outputs respective laser beams related to the secondary colors.

In the laser scan unit, a polygonal mirror is rotated by a polygonal motor, and a laser beam emitted by a laser light source is deflected by the polygonal mirror through the rotation of the polygonal mirror. The laser beam deflected by the polygonal mirror scans the charged surface of the photoconductive medium in a main scan direction. Hence, the photoconductive medium surface is exposed by the laser beam and an electrostatic image related to one of the secondary colors is formed on the photoconductive medium. Each of the electrostatic images related to the secondary colors is visualized by a developing unit by adhering a corresponding one of secondary color toners onto the photoconductive medium.

Such toner images are sequentially transferred from the photoconductive medium to an intermediate transfer belt in an overlaying manner. The intermediate transfer belt serves as an image support and is rotated in accordance with the rotation of the photoconductive medium. Hence, a multicolor image is formed on the intermediate transfer belt, and the multicolor image is transferred from the intermediate transfer belt to a recording material, such as a copy sheet or a plastic sheet.

In the color image forming system, a reference mark is provided at a reference position on the intermediate transfer belt, the reference mark being located outside an image forming area of the intermediate transfer belt. A reference mark sensor is provided to output a reference mark signal every time the reference mark at the reference position on the intermediate transfer belt is detected during rotation of the intermediate transfer belt. The reference mark signal is output by the reference mark sensor at a time the reference position passes through the reference mark sensor per revolution of the intermediate transfer belt.

In the above-mentioned color image forming system, a laser scan start timing for the laser scan unit to start scanning the photoconductive medium by the laser beam is controlled based on the reference mark signal output by the reference mark sensor. According to this control, the scanning of the photoconductive medium in each main scan line is started by the laser scan unit in accordance with the reference mark signal, and the laser scan unit outputs a line sync signal in accordance with the reference mark signal. The scanning of the photoconductive medium in each main scan line by the laser beam is performed in accordance with a period of the line sync signal.

If a peripheral length of the intermediate transfer belt (which is proportional to a time for one revolution of the intermediate transfer belt) is equal to an integral multiple of the period of the line sync signal, no displacement of the toner images on the intermediate transfer belt will be produced when sequentially transferring the toner images from the photoconductive medium to the intermediate transfer belt.

However, it is practically difficult that the peripheral length of the intermediate transfer belt is exactly set at an integral multiple of the period of the line sync signal. Usually, in the above-described color image forming system, the peripheral length of the intermediate transfer belt is deviating from the integral multiple of the period of the line sync signal. The timing for the reference mark sensor to output the reference mark signal may be shifted from the timing for the laser scan unit to output the line sync signal at which the laser scan unit starts scanning the photoconductive medium by the laser beam. This causes displacement of the toner images on the intermediate transfer belt. In such a case, the multicolor image on the intermediate transfer belt has the toner image displacement, and it is difficult for the above-described color image forming system to provide a good-quality color image on the recording material.

One conceivable method to eliminate the above-mentioned problem is to arrange the intermediate transfer belt in the color image forming system, the peripheral length of the intermediate transfer belt being exactly equal to an integral multiple of the period of the line sync signal. However, the intermediate transfer belt is subjected to wavy movement or vibration during the rotation even if the peripheral length of the intermediate transfer belt is accurate. Thus, it is difficult for the above-mentioned method to prevent the timing of outputting the reference mark signal by the reference mark sensor from being shifted from the laser scan start timing by the laser scan unit.

SUMMARY OF THE INVENTION

An object of the present invention is to provide an improved color image forming apparatus in which the above-described problems are eliminated.

Another object of the present invention is to provide a color image forming apparatus which reliably prevents displacement of toner images on the intermediate transfer belt when transferring the toner images from the photoconductive medium to the intermediate transfer belt in an overlaying manner, so that a good-quality color image is provided.

The above-mentioned objects of the present invention are achieved by a color image forming apparatus which includes: an image forming unit which forms a multicolor image on a second image support by sequentially transferring toner images, related to a plurality of colors, from a first image support to the second image support in an overlaying manner; a reference position detecting unit which detects a reference mark signal every time a reference mark at a reference position on the second image support is sensed during rotation of the second image support; a laser scan start timing control unit which controls a laser scan start timing for the image forming unit to start scanning the first image support by a laser beam, based on the reference mark signal detected by the reference position detecting unit; a phase error measurement unit which measures a phase error between a line sync signal from the image forming unit and the reference mark signal from the reference position detecting unit by counting system clocks before the laser scan start timing of the image forming unit; and a drive speed control unit which adjusts a rotating speed of the second image support to a controlled speed by outputting a drive pulse to a motor which rotates the second image support, the drive speed control unit determining an ON-state period of the drive pulse depending on the phase error measurement such that a timing for the reference mark detecting unit to detect the reference mark signal matches the laser scan start timing of the image forming unit.

In the color image forming apparatus of the present invention, the phase error measurement unit measures a phase error between a rising edge of the reference mark signal and a rising edge of the line sync signal so that a compensated laser scan start timing for the phase error is generated. The drive speed control unit outputs a drive pulse to a belt motor of an intermediate transfer belt serving as the second image support. The drive speed control unit controls an ON-state period of the drive pulse depending on the compensated laser scan start timing from the phase error measurement unit, so that the rotating speed at which the intermediate transfer belt is rotated by the belt motor is adjusted to a controlled speed depending on the compensated laser scan start timing, such that a timing for the reference position detecting unit to detect the reference mark signal matches the laser scan start timing of the laser scan unit. Therefore, it is possible for the color image forming apparatus of the present invention to reliably prevent the displacement of the toner images on the intermediate transfer belt. The color image forming apparatus of the present invention is effective in providing a good-quality color image on the recording material.

BRIEF DESCRIPTION OF THE DRAWINGS

Other objects, features and advantages of the present invention will become more apparent from the following detailed description when read in conjunction with the accompanying drawings in which.

DETAILED DESCRIPTION OF THE PREFERRED EMBODIMENTS

A description will now be given of the preferred embodiments of the present invention with reference to the accompanying drawings.

Figure 2:
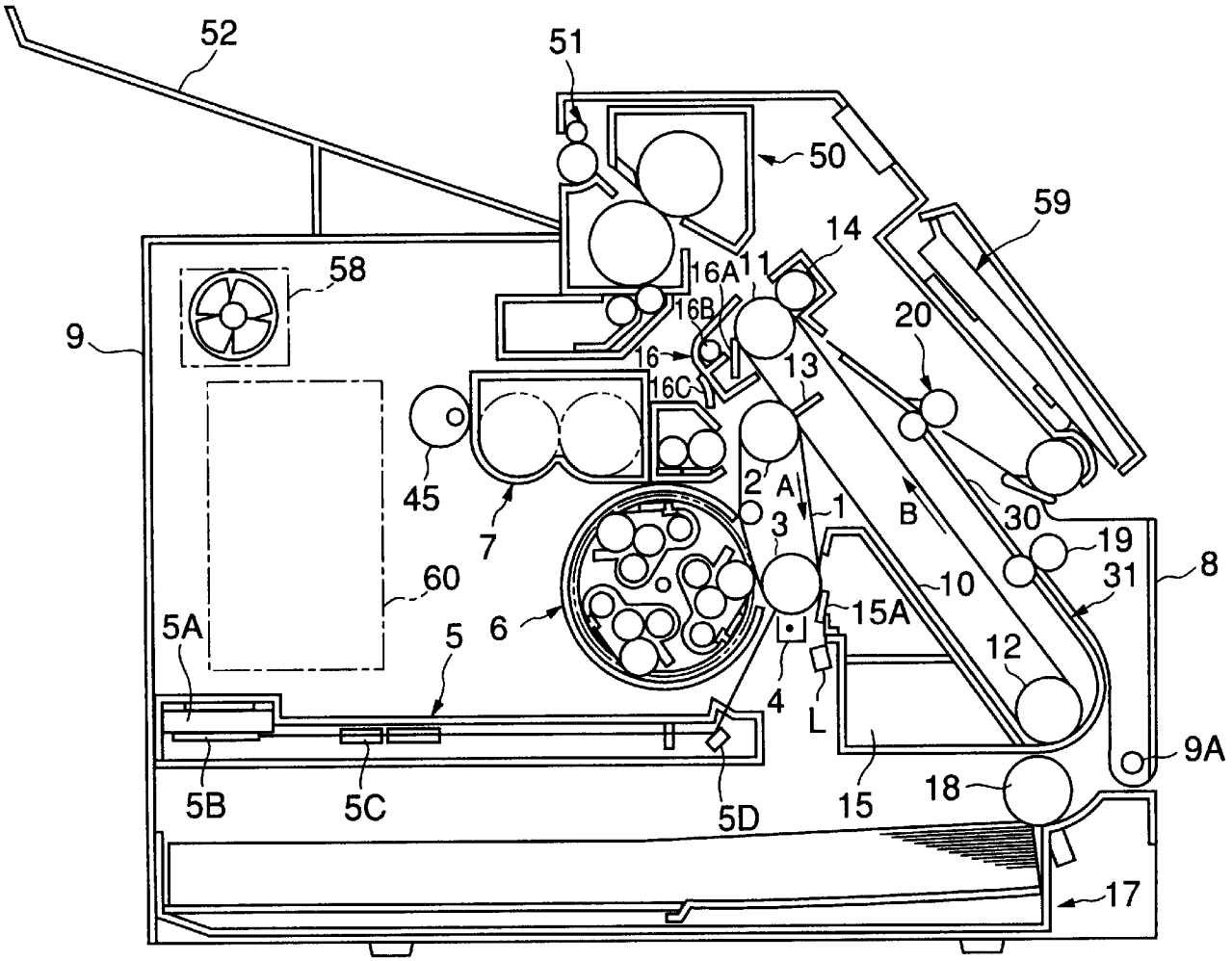
FIG. 2 is a cross-sectional view of a color image forming system to which the present invention is applied.

FIG. 2 shows a color image forming system to which the present invention is applied. For the purpose of illustration of the color image forming system, a color laser beam printer is shown in FIG. 2.

In the color image forming system of FIG. 2, a belt-like photoconductive medium 1 serves as a first image support and is rotatably supported by rollers 2 and 3. When a print start button (not shown) of the color image forming system is pushed, the photoconductive medium 1 is rotated in a direction of an arrow "A" indicated in FIG. 2 by rotation of the rollers 2 and 3.

At lower peripheral portions of the photoconductive medium 1, a charger 4, a discharging lamp L and a cleaning blade 15A are provided. The charger 4 charges the surface of the photoconductive medium 1 when the photoconductive medium 1 is rotated. The discharging lamp L discharges the charged surface of the photoconductive medium 1. The cleaning blade 15A is attached to the photoconductive medium 1. The cleaning blade 15A removes toner on the surface of the photoconductive medium 1 after a toner image of a first color on the photoconductive medium 1 is transferred, and cleans the surface of the photoconductive medium 1 before a next toner image of a second color is formed thereon.

At a downstream position of the charger 4 on the photoconductive medium 1, a laser scan area is provided. A laser scan unit 5 scans the charged surface of the photoconductive medium 1 in the laser scan area in a main scan direction by a laser beam which is turned ON/OFF depending on an image signal. Hence, the surface of the photoconductive medium 1 is exposed by the laser beam and an electrostatic image is formed on the surface of the photoconductive medium 1.

A multicolor developing device 6 is provided at a downstream position of the laser scan area on the photoconductive medium 1. In the multicolor developing device 6, a yellow developing unit, a magenta developing unit and a cyan developing unit are provided, and a yellow toner, a magenta toner and a cyan toner (or secondary color toners) are respectively contained in these developing units.

A black developing unit 7 is provided above the multicolor developing device 6 and around the photoconductive medium 1. The black developing unit 7 contains a black toner.

In the multicolor developing device 6, one of the three developing units is selectively attached to the photoconductive medium 1 at a timing of development with respect to a corresponding one of the secondary color toners. The multicolor developing device 6 adheres a corresponding one of the secondary toners onto regions of the electrostatic image where the charge is eliminated, so as to visualize the electrostatic image on the surface of the photoconductive medium 1 into a toner image. The multicolor developing device 6 is rotatably supported and capable of selectively attaching one of the three developing units to the photoconductive medium 1 by revolution of 360°/3.

When one of the three developing units of the multicolor developing device 6 is attached to the photoconductive medium 1, the black developing unit 4 is separated from the photoconductive medium 1. A cam 45 is connected to the black developing unit 4, and the black developing unit 4 is attached to or separated from the photoconductive medium 1 by rotation of the cam 45. The black developing unit 7 is attached to the photoconductive medium 1 at a timing of development with the black toner. The black developing unit 7 adheres the black toner to the electrostatic image of the photoconductive medium 1 in a manner similar to the multicolor developing device 6.

In the laser scan unit 5, a polygonal motor 5A, a polygonal mirror 5B, an fθ lens 5C, and a mirror 5D are provided. A laser beam emitted by a laser light source (not shown) is directed to the polygonal mirror 5B. The polygonal mirror 5B includes mirror surfaces, and one of the mirror surfaces of the polygonal mirror 5B reflects the laser beam while the polygonal mirror 5B is rotated at a constant speed by the polygonal motor 5A. Due to the rotation of the polygonal mirror 5B, the angle formed by the mirror surface of the polygonal mirror 5B with respect to the laser beam gradually increases. The mirror surface of the polygonal mirror 5B which the laser beam hits changes to the adjacent mirror surface every time the polygonal mirror 5B is rotated by 360°/n where n is an integer. Hence, the laser beam deflected by the polygonal mirror 5B swings repeatedly.

In the laser scan unit 5, the laser beam passed through the fθ lens 5C is reflected to the photoconductive medium 1 by the mirror 5D. Hence, the surface of the photoconductive medium 1 is exposed by the laser beam from the laser scan unit 5, and the electrostatic image is formed on the surface of the photoconductive medium 1.

As described above, the electrostatic image on the photoconductive medium 1 is visualized into a toner image by the multicolor developing device 6 and the black developing unit 7 with a corresponding toner. In the color image forming system of FIG. 2, this procedure is repeated with respect to each of the yellow toner, the magenta toner, the cyan toner and the black toner. Such toner images are sequentially transferred from the photoconductive medium 1 to an intermediate transfer belt 10 in an overlaying manner. A transfer brush 13 is provided inside the intermediate transfer belt 10, and the transfer brush 13 serves to transfer the toner image on the surface of the photoconductive medium 1 to the surface of the intermediate transfer belt 10.

The intermediate transfer belt 10 serves as a second image support and is provided adjacent to the photoconductive medium 1. The intermediate transfer belt 10 is rotatably supported by rollers 11 and 12. During the rotation of the photoconductive medium 1, the intermediate transfer belt 10 is rotated in a direction of an arrow "B" indicated in FIG. 2 by rotation of the rollers 11 and 12.

In the color image forming system of FIG. 2, the intermediate transfer belt 10 is rotated by a belt motor (not shown) at a varying speed which is substantially proportional to an ON-state period (or a pulse width) of a belt motor clock input to the belt motor. Hence, the rotating speed of the intermediate transfer belt 10 can be adjusted to a controlled speed depending on the ON-state period of the belt motor clock to the belt motor, which will be described later.

The toner image on the surface of the photoconductive medium 1 with respect to each of the secondary colors and black is transferred to the surface of the intermediate transfer belt 10 every time the intermediate transfer belt 10 is rotated by one revolution. It is necessary that the toner images related to the secondary colors and black are transferred from the photoconductive medium 1 to the intermediate transfer belt 10 at the same location in an overlaying manner. Hence, a multicolor image is formed on the intermediate transfer belt 10, and the multicolor image is transferred from the intermediate transfer belt 10 to a recording sheet, such as a copy sheet or a plastic sheet.

A transfer roller 14 is provided at a transfer position of the intermediate transfer belt 10, and the transfer roller 14 serves to transfer the multicolor image on the surface of the intermediate transfer belt 10 to the recording sheet.

In the color image forming system of FIG. 2, a paper cassette 17 contains recording sheets, and the recording sheets from the paper cassette 17 are supplied one by one to a paper transport roller 19 by a paper supply roller 18. The paper transport roller 19 transports the recording sheet to a resist roller pair 20 such that the recording sheet is once stopped at the resist roller pair 20. The resist roller pair 20 supplies the recording sheet to the transfer position of the intermediate transfer belt 10 at a controlled time such that the transfer roller 14 properly transfers the multicolor image on the surface of the intermediate transfer belt 10 to the recording sheet in accordance with the rotation of the intermediate transfer belt 10.

A fixing unit 50 is provided above the intermediate transfer belt 10, and the fixing unit 50 subjects the recording sheet to heat and pressure. After the multicolor image is transferred to the recording sheet by the transfer roller 14, the recording sheet is supplied to the fixing unit 50 and subjected to heat and pressure by the fixing unit 50 such that the multicolor image is fixed onto the recording sheet. The recording sheet having the multicolor image formed thereon is ejected to a paper stack portion 52 by an ejection roller pair 51. The paper stack portion 52 is provided on top of a main frame 9 of the color image forming system.

A cleaning unit 16 is provided adjacent to the roller 11 of the intermediate transfer belt 10. The cleaning unit 16 includes a cleaning blade 16A, a toner collecting element 16B and a cleaning blade arm 16C. The cleaning blade 16A is movably connected to the intermediate transfer belt 10 through the cleaning blade arm 16C. The cleaning blade 16A is attached to or separated from the intermediate transfer belt 10 by using the cleaning blade arm 16C.

When the toner image is transferred from the photoconductive medium 1 to the intermediate transfer belt 10, the cleaning blade 16A is separated from the intermediate transfer belt 10. The cleaning blade 16A is attached to the intermediate transfer belt 10 after the multicolor image is transferred from the intermediate transfer belt 10 to the recording sheet. The cleaning blade 16A removes residual toner on the recording sheet after the multicolor image is transferred to the recording sheet.

A toner reservoir 15 is provided at a lower peripheral portion of the intermediate transfer belt 10. The toner from the cleaning blade 16A as well as the toner from the cleaning blade 15A is collected into the toner reservoir 15. The toner reservoir 15 may be changed by a new one when the toner reservoir 15 needs replacement. The toner collecting element 16B provided in the cleaning unit 16 serves to collect the toner from the cleaning blade 16A and to supply the toner to the toner reservoir 15 through a toner supplying unit (not shown).

A paper transport guide 30 is provided to form a paper transport route in which the recording sheet is transported along the paper transport roller 19 and the resist roller pair 20. In the color image forming system of FIG. 2, the photoconductive medium 1, the charger 4, the intermediate transfer belt 10, the cleaning unit 16 and the paper transport guide 30 are incorporated into a process cartridge 31. The process cartridge 31 may be changed by a new one when the process cartridge 31 needs replacement such as an end of an operating life.

Similar to the process cartridge 31, the multicolor developing device 6 and the black developing unit 7 may be changed by new ones when they need replacement. In order to facilitate the replacement of the above-mentioned components or removal of a recording sheet upon a paper jam, the color image forming system of FIG. 2 is configured such that a front frame 8 is re-closable with respect to the main frame 9. The front frame 8 is rotatable around a supporting shaft 9A, and the replacement of the above-mentioned components or the removal of a recording sheet may be easily performed by placing the front frame 8 in an open condition.

In the color image forming system, as shown in FIG. 2, a fan 58 and a small-size paper cassette 59 are provided. The fan 58 serves to move air for cooling of the internal components of the color image forming system. The small-size paper cassette 59 contains a small number of recording sheets and is optionally attached to the color image forming system. Further, a controller 60 which will be described later is provided on a left-hand side of the color image forming system of FIG. 2.

Figure 3:
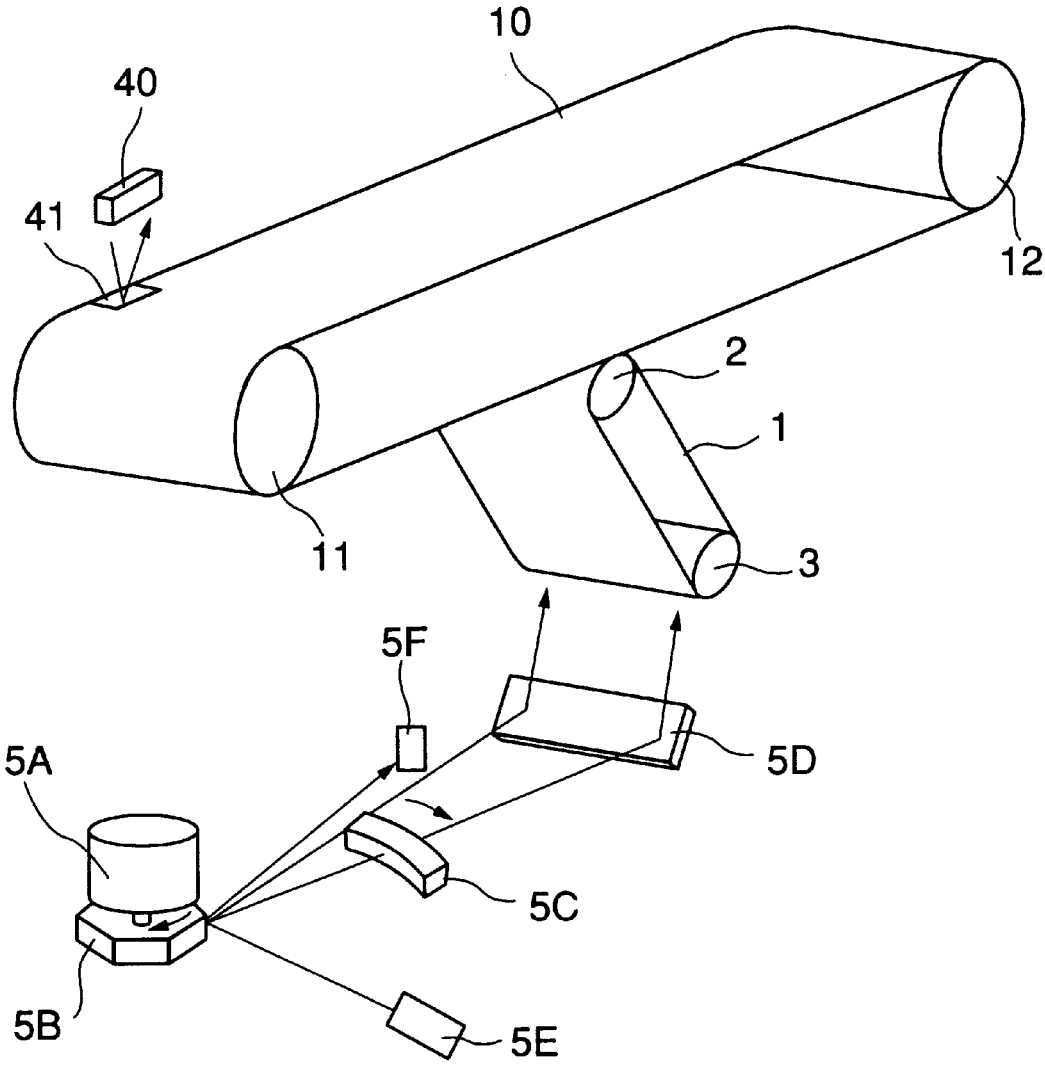
FIG. 3 is an enlarged perspective view of an image forming unit of the color image forming system of FIG. 2.

FIG. 3 shows an image forming unit of the color image forming system of FIG. 2. The image forming unit of FIG. 3 is constituted by the photoconductive medium 1, the laser scan unit 5, the multicolor developing unit 6, and the intermediate transfer belt 10. For the sake of convenience of illustration, the angle at which the intermediate transfer belt 10 is installed in the color image forming system is changed.

At edge portions of the intermediate transfer belt 10, ten reference marks 41 of a light reflecting material are provided (only one reference mark 41 is shown in FIG. 3), and the reference marks 41 are spaced at equal intervals along the longitudinal line of the intermediate transfer belt 10. The reference marks 41 are located outside an image forming area of the intermediate transfer belt 10.

In the color image forming system of FIG. 2, one of the reference marks 41 is provided in order for a laser scan start timing control according to the present invention, and the others are provided in order for other timing controls of the color image forming system.

A reflection type reference mark sensor 40 is provided to output a reference mark signal every time the reference mark 41 (which is provided for the laser scan start timing control) at the reference position on the intermediate transfer belt 10 is detected during the rotation of the intermediate transfer belt 10. Hence, a reference mark signal is output by the reference mark sensor 40 every time the reference position passes through the reference mark sensor 40 during the rotation of the intermediate transfer belt 10.

The laser scan unit 5 starts scanning the photoconductive medium 1 by the laser beam depending on a timing of a reference mark signal output by the reference mark sensor 40. For example, suppose that the laser scan unit 5 starts the scanning of the photoconductive medium 1 by the laser beam with respect to a first color when the reference mark sensor 40 outputs a reference mark signal. After the intermediate transfer belt 10 is rotated one revolution, the laser scan unit 5 restarts the scanning of the photoconductive medium 1 by the laser beam with respect to a second color when the reference mark sensor 40 outputs a reference mark signal at a next time.

An image reading unit (not shown), which is separate from the color image forming apparatus of the present invention, is provided in the color image forming system of FIG. 2. The image reading unit outputs an image signal (or a color-separated image signal) by optically reading an original image on the color image forming system of FIG. 2.

When the image signal from the image reading unit is input to the laser scan unit 5, a laser diode (LD) 5E emits a laser beam which is turned ON/OFF depending on the image signal. The image signal is generated by the image reading unit with respect to each of secondary colors, such as yellow, cyan and magenta, and black. The laser scan unit sequentially outputs respective laser beams related to the secondary colors and black.

In the laser scan unit 5, the polygonal mirror 5B is rotated by the polygonal motor 5A, and the laser beam from the laser diode 5E is deflected by the polygonal mirror 5B through the rotation of the polygonal mirror 5B. The laser beam is passed through the fθ lens 5C and reflected to the photoconductive medium 1 by the mirror 5D. The surface of the photoconductive medium 1 is charged by the charger 4. Hence, the laser beam deflected by the polygonal mirror 5B scans the charged surface of the photoconductive medium 1 in the main scan direction.

As shown in FIG. 3, a line sync detecting sensor 5F is provided outside a laser scanning area of the laser scan unit 5. Every time the laser scan unit 5 scans the charged surface of the photoconductive medium 1 in the main scan direction by the laser beam from the polygonal mirror 5B, the line sync detecting sensor 5F detects the laser beam from the polygonal mirror 5B immediately before the scanning of the photoconductive medium 1 is started, and outputs a line sync signal. A timing for the line sync detecting sensor 5F to output the line sync signal is substantially equal to the laser scan start timing for the laser scan unit 5 to start scanning the photoconductive medium 1 by the laser beam. In the laser scan unit 5, the polygonal mirror 5B is rotated at a constant speed by the polygonal motor 5A depending on a period of a motor sync signal input to the polygonal motor 5A.

The line sync signal from the laser scan unit 5, which is used by the color image forming apparatus of the present invention, is a pulsed signal having a given pulse width, which is produced based on the line sync signal output by the line sync detecting sensor 5F.

In the above-described color image forming system, the image formation to form a multicolor image related to yellow, magenta, cyan and black is carried out. However, the present invention is not limited to the above-described embodiment. In a case of the image formation to form a multicolor image related to three or two different colors, the same procedures as those in the above-described color image forming system may be performed.

Figure 1:
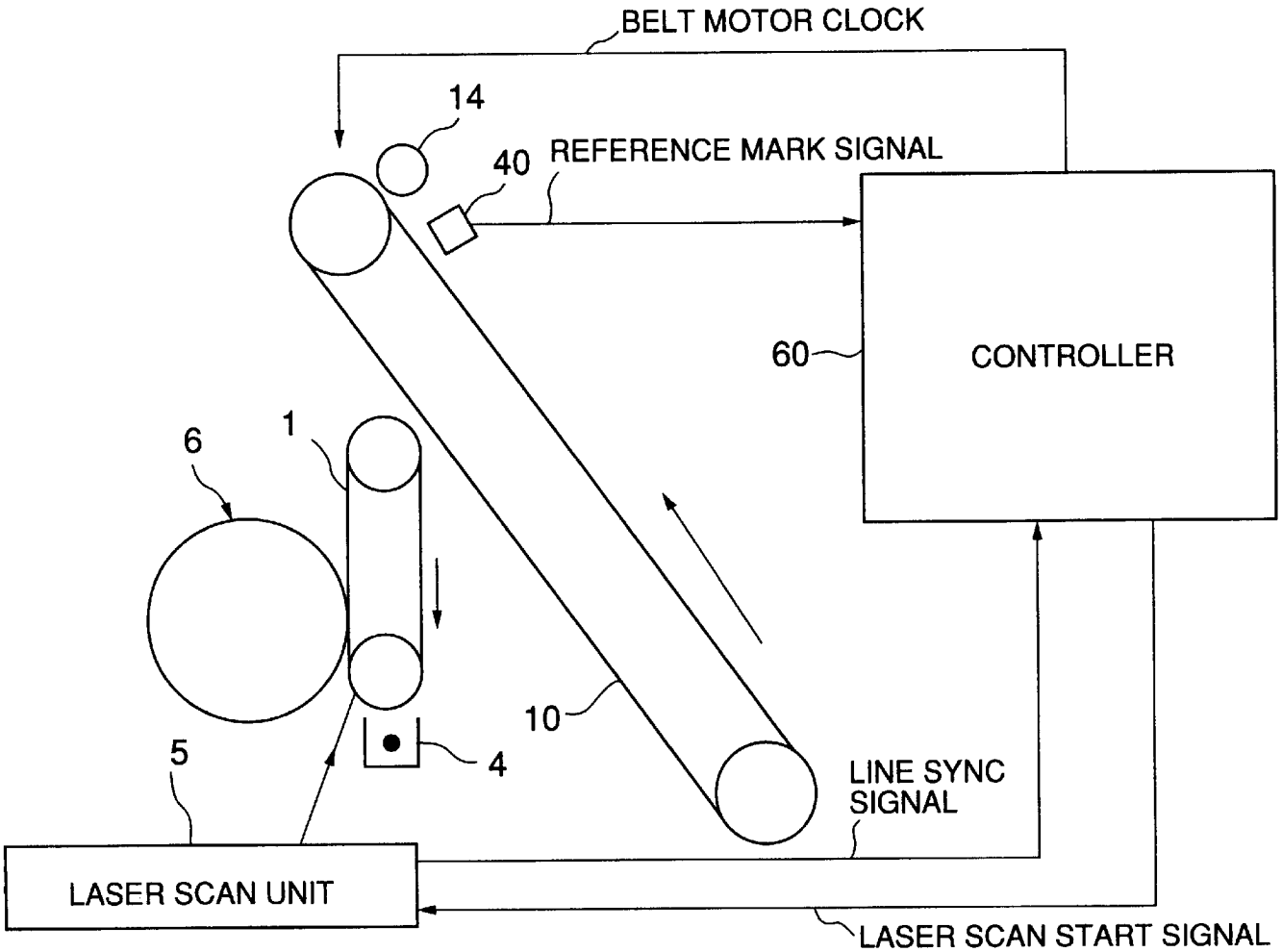
FIG. 1 is a diagram for explaining a color image forming apparatus of the present invention.

FIG. 1 shows a color image forming apparatus of the present invention. In FIG. 1, the elements which are the same as corresponding elements in FIG. 2 are designated by the same reference numerals, and a description thereof will be omitted.

In the color image forming apparatus of FIG. 1, the controller 60 generally has a reference position detecting unit, a laser scan start timing control unit, a phase error measurement unit and a drive speed control unit which will be described in detail later. The reference position detecting unit detects a reference mark signal every time the reference mark at the reference position on the intermediate transfer belt 10 is sensed by the reference mark sensor 40 during the rotation of the intermediate transfer belt 10. The laser scan start timing control unit controls a laser scan start timing for the laser scan unit 5 to start scanning the photoconductive medium 1 by the laser beam based on the reference mark signal. The phase error measurement unit measures a phase error between a line sync signal from the laser scan unit 5 and the reference mark signal by counting system clocks before the laser scan start timing. The drive speed control unit adjusts a rotating speed of the intermediate transfer belt 10 to a controlled speed by outputting a belt motor clock to a motor which rotates the intermediate transfer belt 10.

Figure 4:
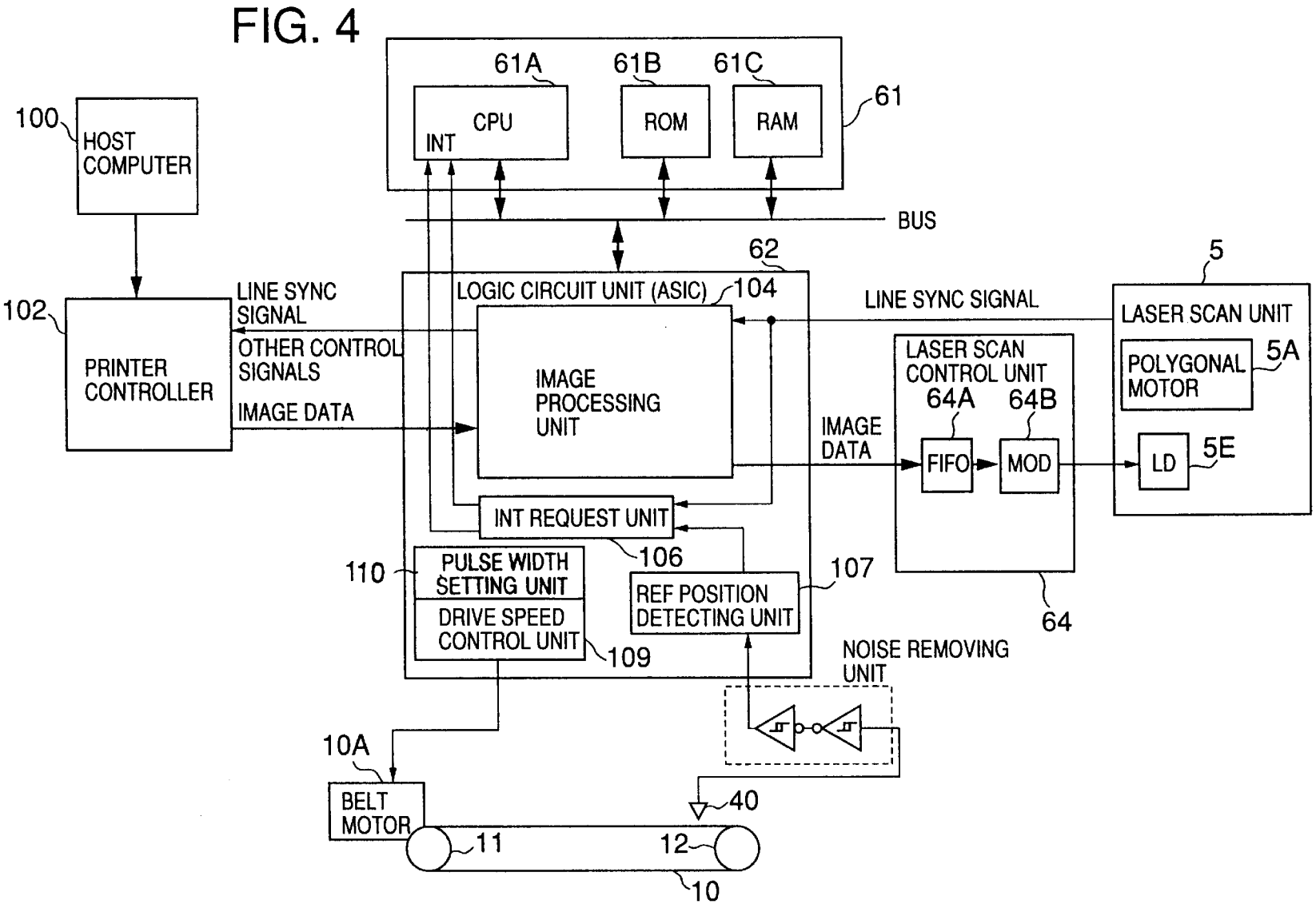
FIG. 4 is a diagram for explaining a configuration of a controller of the color image forming apparatus of the present invention in which a phase error measurement unit is constituted by software of a microcomputer.

FIG. 4 shows a configuration of the controller of the color image forming apparatus of the present invention in which a phase error measurement unit is constituted by software of a microcomputer.

As shown in FIG. 4, in the above-described color image forming system, the controller 60 is basically constituted by a microcomputer 61, a logic circuit unit 62 and a laser scan control unit 64. The controller 60 may include a noise removing unit as shown in FIG. 4. In the color image forming system of FIG. 2, a host computer 100 supplies image data to a printer controller 102. The printer controller 102 expands the image data from the host computer 100 into bit map data to be printed. The printer controller 102 supplies such image data to an image processing unit 104 of the logic circuit unit 62. The image processing unit 104 processes the image data from the printer controller 102 and supplies the processed image data to the laser scan control unit 64.

The laser scan control unit 64 includes a first-in first-out (FIFO) unit 64A and a modulator (MOD) unit 64B. The FIFO unit 64A serves to supply the image data from the image processing unit 104 to the laser scan unit 5 at a controlled timing in accordance with a timing for the laser scan unit 5 to start scanning of the photoconductive medium 1 by the laser beam. The modulator unit 64B converts the image data (digital) from the FIFO unit 64A into a modulated image signal (analog). The laser scan control unit 64 supplies the image signal to the laser diode (LD) 5E of the laser scan unit 5 at the controlled timing.

The microcomputer 61 controls the overall operation of the color image forming system such as that shown in FIG. 2. The overall operation of the color image forming system is performed in synchronism with system clocks. The microcomputer 61 includes a CPU (central processing unit) 61A, a ROM (read only memory) 61B, and a RAM (random access memory) 61C. The ROM 61B stores a program to control various procedures of the color image forming system, and the program is executed by the CPU 61A. The RAM 61C provides a working memory area used by the CPU 61A when the program is executed.

The logic circuit unit 62 is an ASIC (application-specific integrated circuit) including various logic circuits related to the color image forming system, such as the image processing unit 104 and the elements of the color image forming apparatus of the present invention. The microcomputer 61 and the logic circuit unit 62 are connected by a bus, and signals are exchanged between the microcomputer 61 and the logic circuit unit 62 through the bus.

As described above, in the controller 60 of FIG. 4, the phase error measurement unit according to the present invention is constituted by the software of the microcomputer 61. In the logic circuit unit 62, an interrupt request unit 106, a reference position detecting unit 107, a drive speed control unit 109 and a pulse width setting unit 110 are provided in addition to the image processing unit 104. In the microcomputer 61, a program prepared to control a phase error measurement procedure of the present invention is stored in the ROM 61B. The CPU 61A receives interrupt requests from the interrupt request unit 106, and carries out the phase error measurement procedure in accordance with the program upon receiving the interrupt requests, which will be described later. Specifically, the interrupt request unit 106 outputs an interrupt request (INT) to the CPU 61A in response to a rising edge of the reference mark signal from the reference mark sensor 40, and the CPU 61A starts performing the phase error measurement upon receiving the interrupt request. The interrupt request unit 106 outputs an interrupt request (INT) to the CPU 61A in response to a rising edge of the line sync signal from the laser scan unit 5, and the CPU 61A ends the performance of the phase error measurement upon receiving the interrupt request.

In the logic circuit unit 62 of FIG. 4, the reference position detecting unit 107 detects the reference mark signal output by the reference mark sensor 40. In order to provide accurate detection, the reference mark signal, output by the reference mark sensor 40, may be passed through the noise removing unit to the reference position detecting unit 107 as shown in FIG. 4. In the controller 60, the laser scan control unit 64 supplies the image signal to the laser diode (LD) 5E of the laser scan unit 5 at the controlled timing. Hence, the color image forming apparatus of the present invention includes a laser scan start timing control unit which controls a laser scan start timing for the laser scan unit 5 to start the scanning of the photoconductive medium 1 by the laser beam based on the reference mark signal. The drive speed control unit 109 adjusts a rotating speed of the intermediate transfer belt 10 to a controlled speed by outputting a drive pulse to a belt motor 10A which rotates the intermediate transfer belt 10. The drive speed control unit 109 determines an ON-state period of the drive pulse depending on the phase error measurement such that a timing of detection of the reference mark signal matches the laser scan start timing. In the drive speed control unit 109, the ON-state period of the drive pulse output to the belt motor 10A is determined as a compensated count of system clocks, and the compensated count of system clocks is used for the drive speed control of the belt motor 10A. In other words, a pulse width of the drive pulse output to the belt motor 10A is set depending on the phase error measurement, and the pulse width is retained in the drive speed control unit 109.

Figure 5:
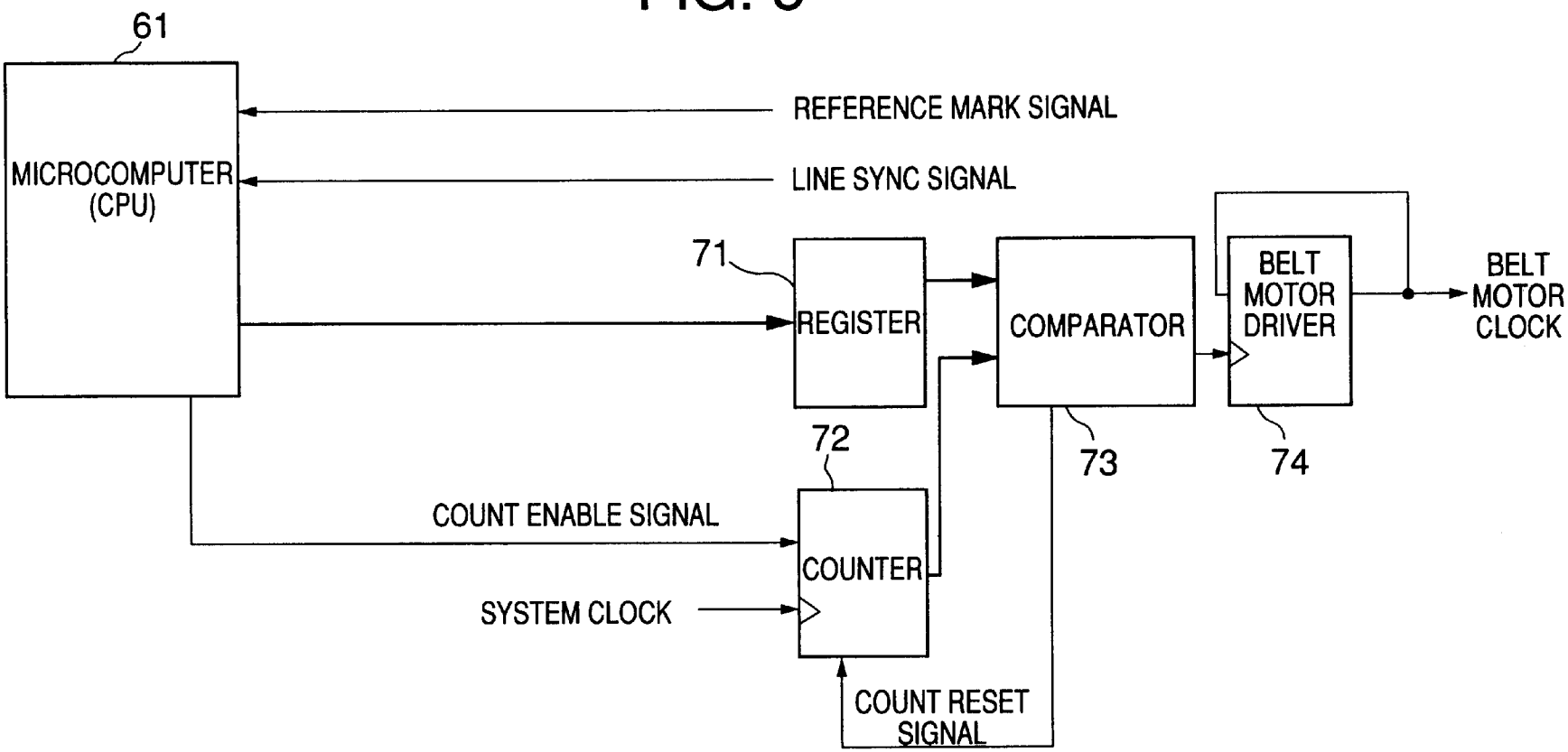
FIG. 5 is a block diagram of an embodiment of the color image forming apparatus of the present invention in the controller of FIG. 4.

FIG. 5 shows an embodiment of the color image forming apparatus of the present invention in the controller of FIG. 4. Specifically, a configuration of the drive speed control unit 109 in the controller 60 is shown in FIG. 5.

As shown in FIG. 5, the drive speed control unit 109, which is provided in the logic circuit unit 62 of FIG. 4, includes a counter 72, a comparator 73, and a belt motor driver 74. The pulse width setting unit 110, which is also provided in the logic circuit unit 62 of FIG. 4, includes a register 71. The drive speed control unit 109 of FIG. 5 supplies a compensated drive pulse to the belt motor (not shown) for rotating the intermediate transfer belt 10.

In the drive speed control unit 109 of FIG. 5, the register 71 retains a count of system clocks. The belt motor clock output to the belt motor 10A is generated based on the value (or the count of system clocks) retained by the register 71. In the color image forming apparatus of the present invention, the count of system clocks output to the register 71 is compensated depending on the phase error measurement, which will be described later.

The counter 72 is set in an ON state when a count enable signal from the microcomputer 61 is input to the counter 72. Immediately when the counter 72 is set in the ON state, the counter 72 starts counting the system clocks. When a count reset signal from the comparator 73 is input to the counter 72, the counter 72 ends the counting, and the count of the system clocks in the counter 72 is reset to zero.

The comparator 73 compares the value (the count of system clocks) output by the register 71 with the count of system clocks output by the counter 72. When a match takes place, the comparator 73 outputs a count reset signal.

When no output signal of the comparator 73 is input to the belt motor driver 74, the belt motor driver 74 maintains an ON/OFF state of a belt motor clock to the belt motor 10A for rotating the intermediate transfer belt 10. When an output signal of the comparator 73 is input to the belt motor driver 74, the belt motor driver 74 switches the belt motor clock to one of an ON state and an OFF state. Hence, every time the count of the system clocks by the counter 72 matches the value (the count of system clocks) of the register 71, a rising edge or a falling edge of the belt motor clock, sent from the belt motor driver 74 to the belt motor 10A, is produced.

In the drive speed control unit of FIG. 5, an ON-state period of the drive pulse (or a period between a rising edge of the belt motor clock and a falling edge of the belt motor clock), output from the belt drive motor 74 to the belt motor 10A, is determined depending on the compensated count of system clocks.

The intermediate transfer belt 10 is rotated by the belt motor 10A at a varying speed which is substantially proportional to the ON-state period of the belt motor clock input to the belt motor 10A. Hence, the rotating speed of the intermediate transfer belt 10 can be adjusted to a controlled speed depending on the compensated count of system clocks.

Figure 6:
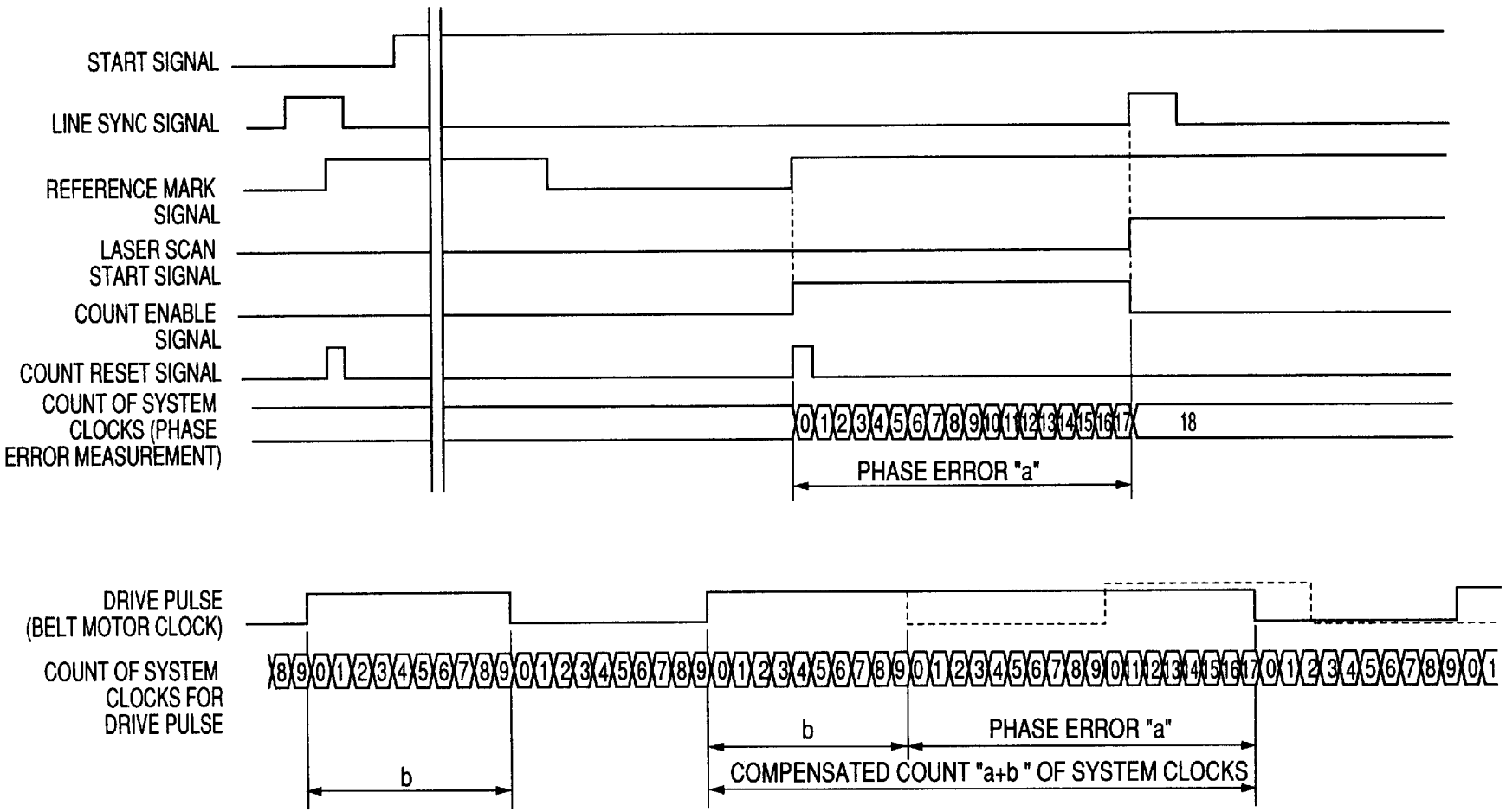
FIG. 6 is a time chart for explaining an operation of a phase error measurement unit in the color image forming apparatus.

FIG. 6 is a time chart for explaining an operation of the phase error measurement unit in the controller 60 of the color image forming apparatus of FIG. 1. In the color image forming apparatus of the present invention, the phase error measurement unit is constituted by either a program of the microcomputer 61 or a logic circuit of the logic circuit unit 62 in the controller 60. In other words, the phase error measurement unit is constituted by either the software of the microcomputer 61 or hardware of the logic circuit unit 62. As a result of the phase error measurement, a compensated count of system clocks is output to the register 71 in the drive speed control unit of FIG. 5.

The ON-state period of the belt motor clock (or the drive pulse) output to the belt motor 10A is controlled depending on the compensated count of system clocks. Hence, the rotating speed of the intermediate transfer belt 10 can be adjusted to a controlled speed depending on the compensated count of system clocks, such that the timing of detection of the reference mark signal by the reference position detecting unit 107 matches the laser scan start timing of the laser scan unit 5.

In the controller 60, the reference mark signal output by the reference mark sensor 40 due to the reference mark 41 (provided for the laser scan start timing control) is input to the reference position detecting unit 107. The reference position detecting unit 107 detects a LOW to HIGH change (or the rising edge) of the reference mark signal from the reference mark sensor 40. The microcomputer 61 is notified by the interrupt request from the interrupt request unit 106 that the rising edge of the reference mark signal has occurred. Then, the microcomputer 61 outputs a START signal as shown in FIG. 6.

The START signal is, as shown in FIG. 6, set in an ON state by the microcomputer 61 in accordance with the program stored in the ROM 61B of the microcomputer 61. Practically, the time for the microcomputer 61 to set the START signal in the ON state is slightly delayed from the rising edge of the reference mark signal from the reference mark sensor 40 due to a delay in the processing of the program executed by the CPU 61A of the microcomputer 61.

A LINE SYNC signal, shown in FIG. 6, is sent from the laser scan unit 5 to the controller 60. The scanning of the photoconductive medium 10 in the main scan direction by the laser beam is started by the laser scan unit 5 in synchronism with a rising edge of the LINE SYNC signal. The LINE SYNC signal from the laser scan unit 5 is not synchronous with the REFERENCE MARK signal from the reference mark sensor 40. In the present embodiment, when a next rising edge of the REFERENCE MARK signal has occurred after the microcomputer 61 first sets the START signal in the ON state, the logic circuit unit 62 sets the LASER SCAN START signal in an ON state in synchronism with a next rising edge of the LINE SYNC signal, as shown in FIG. 6.

In the present embodiment, the laser scan start timing control unit in the controller 60 of FIG. 1 controls a laser scan start timing for the laser scan unit 5 to start scanning the photoconductive medium 10 by the laser beam based on the REFERENCE MARK signal output by the reference mark sensor 40.

Generally, the line sync signal from the laser scan unit 5 is not synchronous with the reference mark signal from the reference mark sensor 40, and it is unpredictable when the microcomputer 61 sets the START signal in the ON state. Hence, in the color image forming system of FIG. 2, the logic circuit unit 62 does not set the LASER SCAN START signal in an ON state at the time the microcomputer 61 has just set the START signal in the ON state.

A phase error between a rising edge of the LINE SYNC signal and a rising edge of the REFERENCE MARK signal is, at the maximum, equal to one period of the LINE SYNC signal. In the present embodiment, immediately before the LASER SCAN START signal is set in the ON state, the phase error measurement unit (or the software of the microcomputer 61) in the controller 60 measures a phase error between the rising edge of the LINE SYNC signal and the rising edge of the REFERENCE MARK signal by counting the system clocks.

As shown in FIG. 6, the COUNT ENABLE signal, sent from the microcomputer 61 to the counter 72, is set in an ON state at the next rising edge of the REFERENCE MARK signal after the microcomputer 61 first sets the START signal in the ON state. The COUNT ENABLE signal is set in an OFF state at the next rising edge of the LINE SYNC signal. The counter 72 counts the system clocks for the ON-state period of the COUNT ENABLE signal, which corresponds to the period of the phase error, so that a count "a" of system clocks for the phase error is output. Hence, the phase error measurement unit measures the phase error "a" by counting the system clocks for the ON-state period of the COUNT ENABLE signal.

As a result of the phase error measurement, a compensated count of system clocks is output to the register 71 in the drive speed control unit of FIG. 5. As shown in FIG. 6, the compensated count of system clocks is determined by inserting the phase error "a" (the count of system clocks)

into a previous count "b" of system clocks before the phase error measurement is started.

The ON-state period of the belt motor clock (or the drive pulse), sent from the belt motor driver 74 to the belt motor 10A, is controlled depending on the compensated count ("a+b") of system clocks output by the microcomputer 61. Hence, in the drive speed control unit of FIG. 5, the rotating speed of the intermediate transfer belt 10 can be adjusted to a controlled speed depending on the compensated count of system clocks, such that the timing of outputting the reference mark signal by the reference mark sensor 40 matches the laser scan start timing by the laser scan unit 5.

Accordingly, in the color image forming apparatus of FIG. 1, it is possible to reliably prevent the displacement of the toner images on the intermediate transfer belt due to the phase error between the reference mark signal timing and the laser scan start timing. The color image forming apparatus of the present embodiment is effective in reliably producing a good-quality color image.

As described above, in the color image forming apparatus of the present invention, the phase error measurement unit is constituted by either the program (the software) of the microcomputer 61 or the logic circuit (the hardware) of the logic circuit unit 62 in the controller 60.

In a case in which the phase error measurement unit is constituted by the program of the microcomputer 61, setting the COUNT ENABLE signal in the ON state is performed by causing interruption of the microcomputer 61 at the time of the next rising edge of the REFERENCE MARK signal, and setting the COUNT ENABLE signal in the OFF state is performed by causing interruption of the microcomputer 61 at the time of the next rising edge of the LINE SYNC signal. The counter 72 counts the system clocks for the ON-state period of the COUNT ENABLE signal, corresponding to the phase error, so that a phase error "a" is produced. The phase error measurement unit of the present embodiment measures the phase error "a" by counting the system clocks for the ON-state period of the COUNT ENABLE signal in accordance with the program.

In a case in which the phase error measurement unit is constituted by the logic circuit of the logic circuit unit 62 in the controller 60, the logic circuit is specifically designed to provide the phase error measurement according to the present invention. For example, the logic circuit includes an additional counter (not shown) provided therein. The additional counter is used to generate a COUNT ENABLE signal which is continuously set in an ON state from the timing of the rising edge of the REFERENCE MARK signal to the timing of the rising edge of the LINE SYNC signal. Similar to the above-mentioned software case, the counter 72 counts the system clocks for the ON-state period of the COUNT ENABLE signal, corresponding to the phase error, so that a phase error "a" is produced. The additional counter is reset or initialized every time a rising edge of the REFERENCE MARK signal occurs.

Figure 7A:
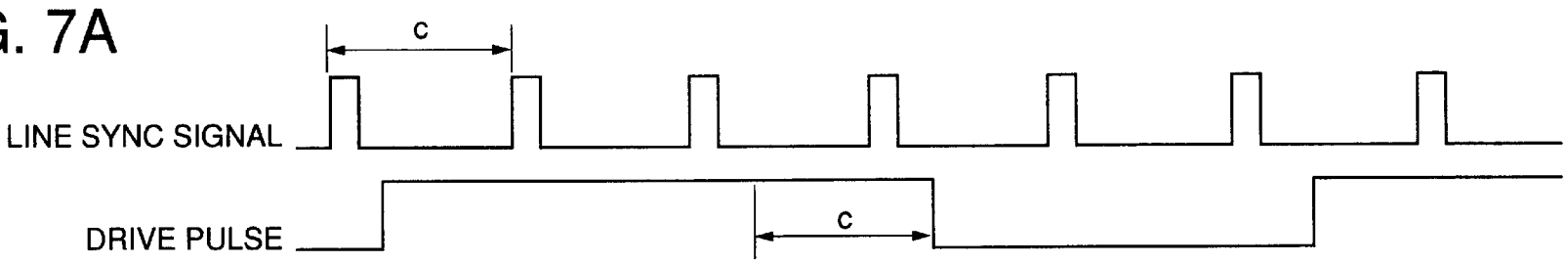
FIG. 7A and FIG. 7B are time charts for explaining a frequency difference between a line sync signal and a belt motor clock.
Figure 7B:
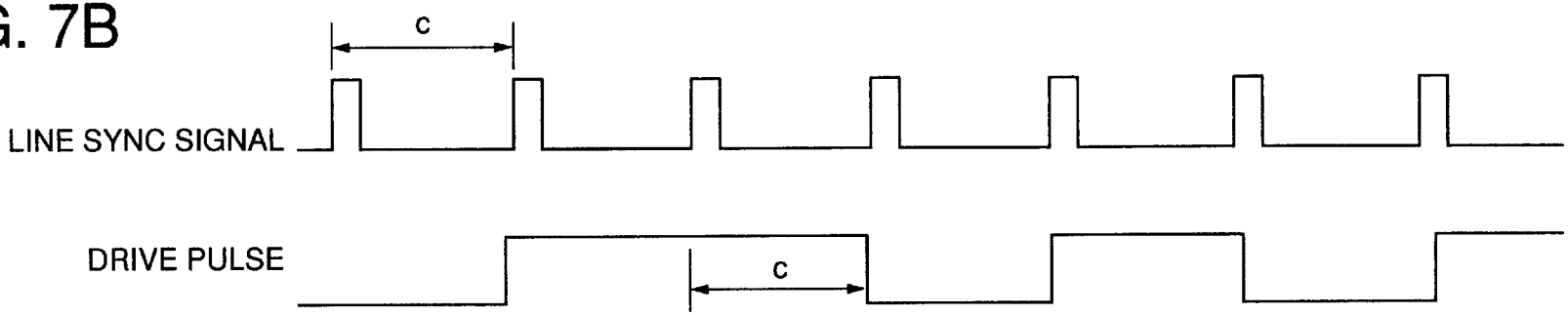

FIG. 7A and FIG. 7B are time charts for explaining a frequency difference between the line sync signal and the drive pulse (or the belt motor clock).

In a case in which a frequency of the drive pulse is rather smaller than a frequency of the line sync signal, as shown in FIG. 7A, it is possible to determine the compensated count "a+b" of system clocks by inserting the phase error "a" into the previous count "b" of system clocks. In FIG. 7A, "c" indicates a period of the line sync signal, which is equal to the maximum phase error between a rising edge of the line sync signal and a rising edge of the reference mark signal.

However, in a case in which a frequency of the drive pulse is nearly equal to (or larger than) a frequency of the line sync signal, as shown in FIG. 7B, a period corresponding to the compensated count "a+b" of system clocks, determined by inserting the phase error "a" (the count of system clocks) into the previous count "b" of system clocks, may be larger than half a period "c" of the line sync signal. In such a case, the belt motor clock is not supplied to the belt motor 10A for an excessively long period, and the control of the rotating speed of the intermediate transfer belt 10 by the drive speed control unit through the belt motor 10A becomes ineffective.

In order to eliminate the above-mentioned problem in the case of FIG. 7B, a compensated count of system clocks is output to the register 71 "n" times, the compensated count being determined by inserting 1/n of the phase error "a" (the count of system clocks) into the previous count "b" of system clocks where "n" is an integer ($n \geqq 1$).

Figure 8:
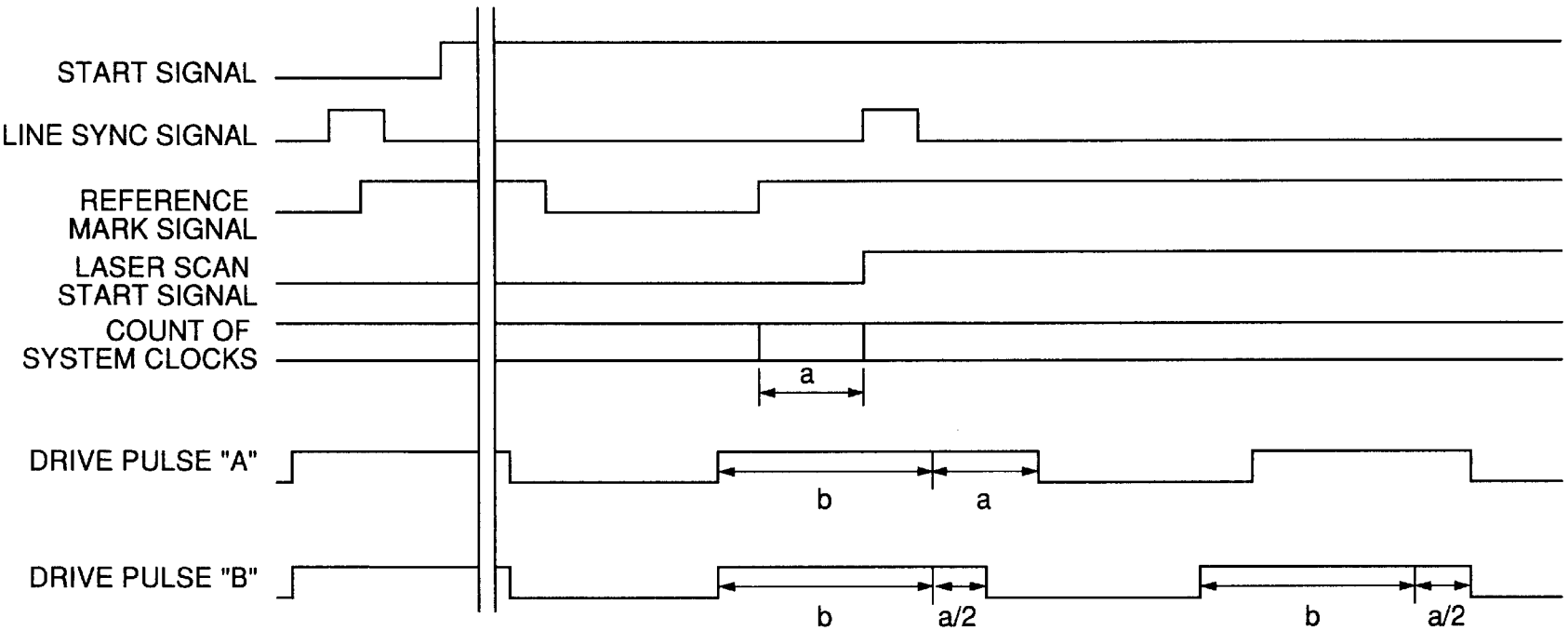
FIG. 8 is a time chart for explaining another embodiment of the controller of the color image forming apparatus of the present invention.

FIG. 8 is a time chart for explaining another embodiment of the controller 60 of the color image forming apparatus of FIG. 1.

In the present embodiment, as a result of the phase error measurement procedure, a compensated count "a/2+b" of system clocks is output to the register 71 in the drive speed control unit of FIG. 5 twice, the compensated count being determined by inserting 1/2 of the phase error "a" into the previous count "b" of system clocks, as indicated by a DRIVE PULSE "B" in FIG. 8. In a case of a DRIVE PULSE "A" in FIG. 8, as the belt motor clock is not supplied to the belt motor 10A for an excessively long period, it is difficult to smoothly control the rotating speed of the intermediate transfer belt 10 by the belt motor 10A.

The ON-state period of the belt motor clock (or the drive pulse), output to the belt motor 10A, is controlled twice depending on the compensated count "a/2+b" of system clocks. Hence, the rotating speed of the intermediate transfer belt 10 can be smoothly adjusted to a controlled speed depending on the compensated count of system clocks, such that the timing of detection of the reference mark signal by the reference position detecting unit 107 matches the laser scan start timing of the laser scan unit 5.

Figure 9:
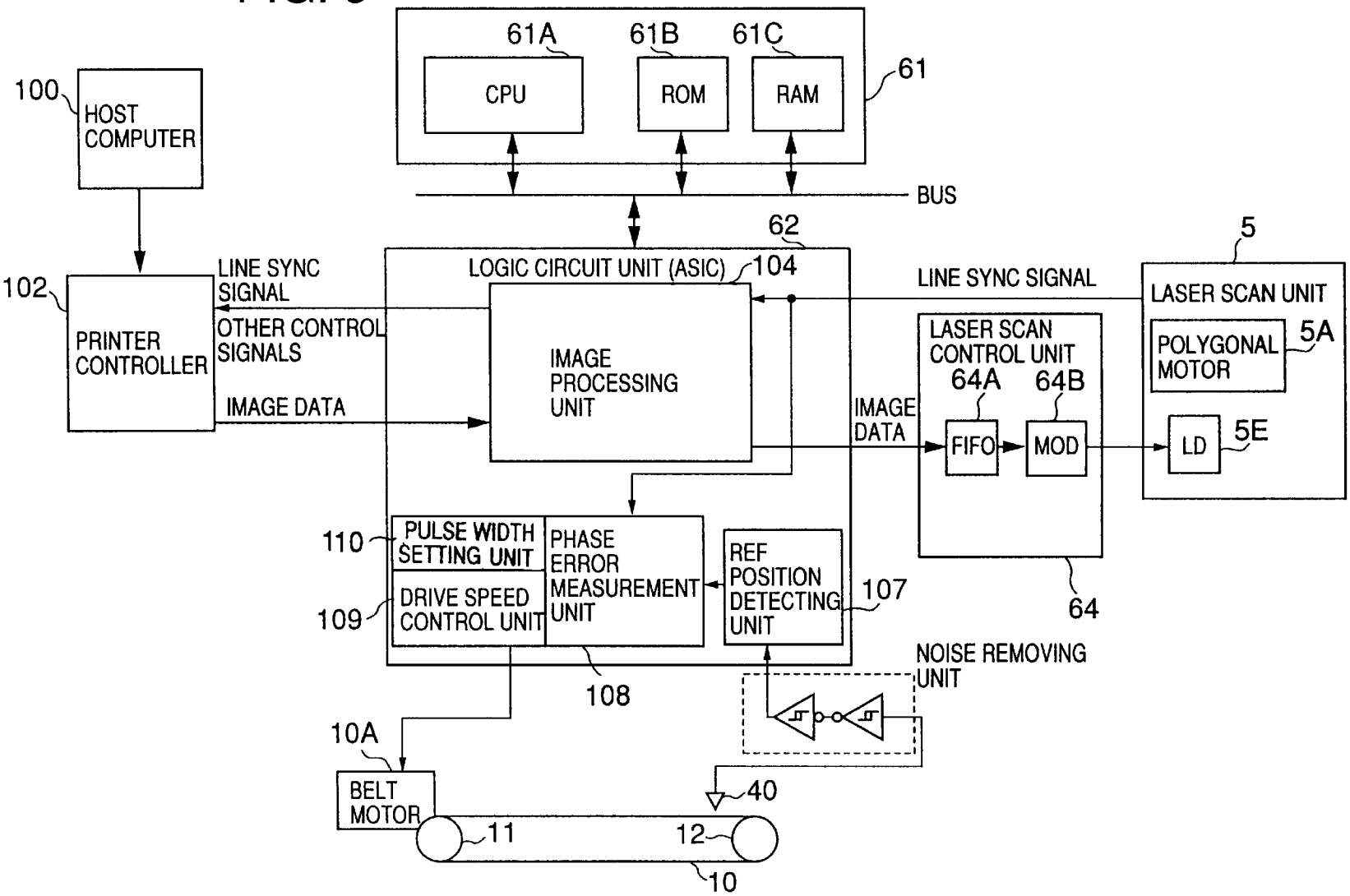
FIG. 9 is a diagram for explaining a configuration of the controller of the color image forming apparatus in which a phase error measurement unit is constituted by hardware of a logic circuit unit.

FIG. 9 shows a configuration of the controller 60 of the color image forming apparatus in which the phase error measurement unit is constituted by the hardware of the logic circuit unit 62.

In FIG. 9, the elements which are the same as corresponding elements in FIG. 4 are designated by the same reference numerals, and a description thereof will be omitted.

As shown in FIG. 9, the logic circuit unit 62 includes a phase error measurement unit 108, instead of the interrupt request unit 106 as in the logic circuit unit 62 of FIG. 4. The phase error measurement unit 108 is specifically designed to provide the phase error measurement according to the present invention. Other elements of the controller 60 of FIG. 9 are essentially the same as corresponding elements of the controller 60 of FIG. 4.

Figure 10:
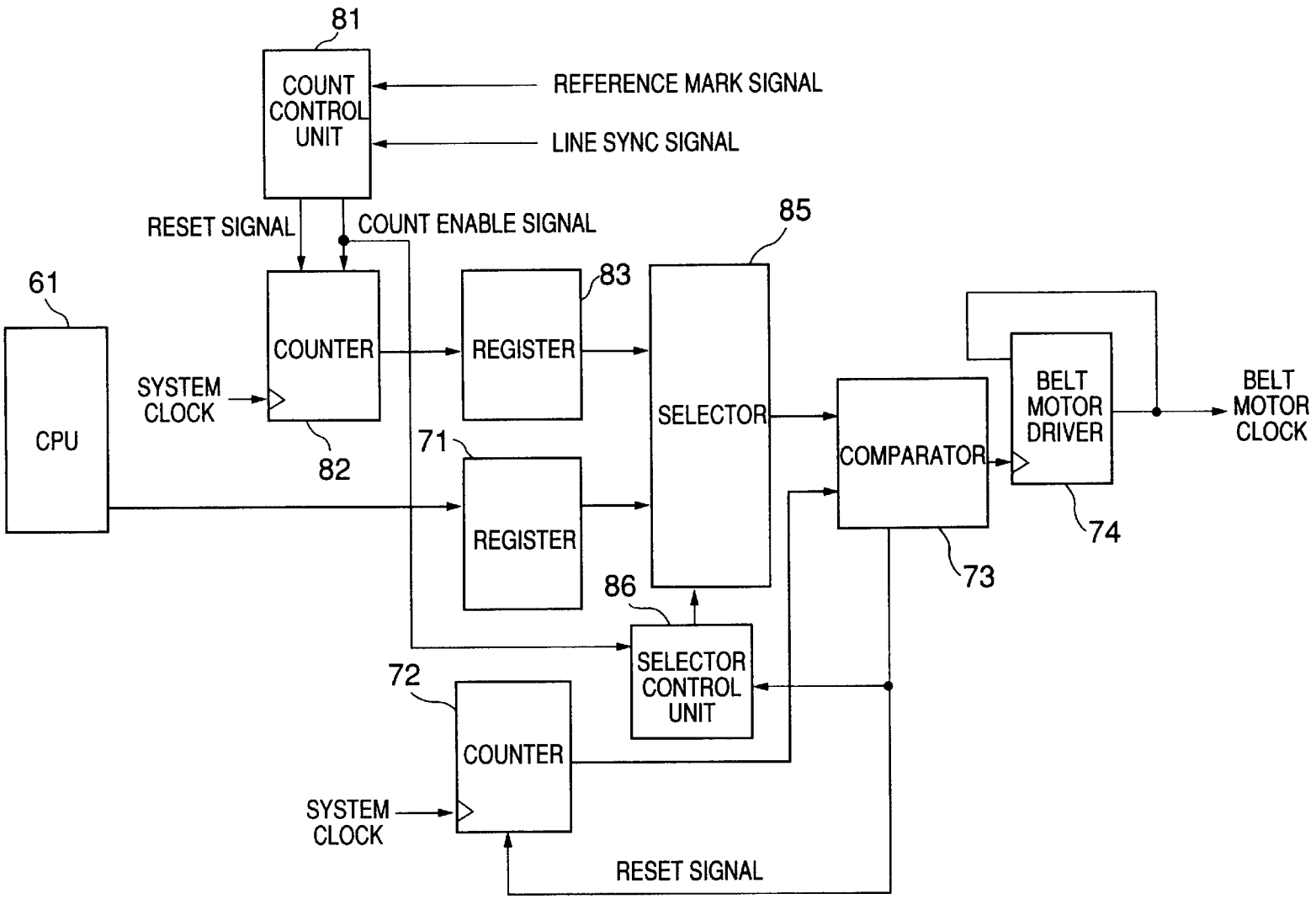
FIG. 10 is a block diagram of an embodiment of the color image forming apparatus of the present invention in the controller of FIG. 9.

FIG. 10 shows an embodiment of the color image forming apparatus of the present invention in the controller of FIG. 9. Specifically, a configuration of the phase error measurement unit 108 and the drive speed control unit 109 in the present embodiment is shown in FIG. 10.

In FIG. 10, the elements which are the same as corresponding elements in FIG. 5 are designated by the same reference numerals, and a description thereof will be omitted.

As shown in FIG. 10, the phase error measurement unit 108, which is provided in the logic circuit unit 62 of FIG. 9, includes a count control unit 81 and a phase error counter 82. The drive speed control unit 109 includes the counter 72, the comparator 73, and the belt motor driver 74. The drive speed control unit 109 of the present embodiment supplies a compensated drive pulse to the belt motor (not shown) for rotating the intermediate transfer belt 10. The pulse width setting unit 110, which is provided in the logic circuit unit 62 of FIG. 9, includes the register 71 and a register 83. Further, a selector 85 and a selector control unit 86 are provided in the present embodiment.

In the phase error measurement unit 108 of the present embodiment, the reference mark signal from the reference mark sensor 40 and the line sync signal from the laser scan unit 5 are input to the count control unit 81. As shown in FIG. 6, the line sync signal is not synchronous with the reference mark signal. The count control unit 81 outputs a count enable signal (which is set in an ON state) to the phase error counter 82 at a rising edge of the reference mark signal, and, at the same time, outputs a count reset signal to the phase error counter 82. Hence, the phase error counter 82 is reset to zero and starts counting system clocks at the rising edge of the reference mark signal.

The count control unit 81 outputs the count enable signal (which is set in an OFF state) to the phase error counter 82 at a rising edge of the line sync signal after the start signal is set in an ON state. Hence, the phase error counter 82 ends the counting of system clocks at the rising edge of the line sync signal, and outputs a count of system clocks for the phase error to the register 83. Also, the count enable signal from the count control unit 81 is output to the selector control unit 86 in a similar manner.

In the drive speed control unit 109 of the present embodiment, the register 83 retains the count of system clocks output by the phase error counter 82. The selector 85 selects one of the count of system clocks output by the register 83 and the count of system clocks output by the register 71, depending on a selection signal output by the selector control unit 86. The selected count from the selector 85 is output to the comparator 73.

Similar to the embodiment of FIG. 5, the register 71 retains the count of system clocks. The belt motor clock output to the belt motor 10A is generated based on the value (or the count of system clocks) retained by the register 71. In the present embodiment, the count of system clocks input to the register 71 is compensated depending on the phase error measurement. The compensated count of system clocks from the register 71 is supplied through the selector 85 to the comparator 73.

The counter 72 starts counting the system clocks immediately after a count reset signal from the comparator 73 is input to the counter 72, and the count of system clocks from the counter 72 is output to the comparator 73.

In the drive speed control unit 109 of the present embodiment, when a compensated drive pulse is not supplied to the belt motor 10A, the selector 85 outputs the count of system clocks from the register 71 to the comparator 73. When a compensated drive pulse is supplied to the belt motor 10A, the selector 85 outputs the count of system clocks for the phase error from the register 83 to the comparator 73. The selector control unit 86 controls the operation of the selector 85 in this manner.

The comparator 73 compares the value (the count of system clocks) output by the selector 85 with the count of system clocks output by the counter 72. When a match takes place, the comparator 73 outputs the count reset signal to both the counter 72 and the selector control unit 86.

When no output signal of the comparator 73 is input to the belt motor driver 74, the belt motor driver 74 maintains an ON/OFF state of the belt motor clock output to the belt motor 10A. When an output signal of the comparator 73 is input to the belt motor driver 74, the belt motor driver 74 switches the belt motor clock to one of an ON state and an OFF state. Hence, every time the count of the system clocks by the counter 72 matches the value (the count of system clocks) by the selector 85, a rising edge or a falling edge of the belt motor clock output to the belt motor 10A, is produced.

Accordingly, similar to the embodiment of FIG. 5, the drive speed control unit 109 of the present embodiment determines the ON-state period of the drive pulse, output from the belt drive motor 74 to the belt motor 10A, depending on the compensated count of system clocks.

Further, the present invention is not limited to the above-described embodiments, and variations and modifications may be made without departing from the scope of the present invention.

What is claimed is:

1. A color image forming apparatus comprising:

an image forming unit for forming a multicolor image on a second image support by sequentially transferring toner images related to a plurality of colors from a first image support to the second image support in an overlaying manner;

a reference position detecting unit for detecting a reference mark signal every time a reference mark at a reference position on the second image support is sensed during rotation of the second image support;

a laser scan start timing control unit for controlling a laser scan start timing for the image forming unit to start scanning the first image support by a laser beam, based on the reference mark signal detected by the reference position detecting unit;

a phase error measurement unit for measuring a phase error between a line sync signal from the image forming unit and the reference mark signal from the reference position detecting unit by counting system clocks before the laser scan start timing; and a drive speed control unit for adjusting a rotating speed of the second image support to a controlled speed by outputting a drive pulse to a motor which rotates the second image support, the drive speed control unit determining an ON-state period of the drive pulse depending on the phase error measurement such that a timing for the reference mark detecting unit to detect the reference mark signal matches the laser scan start timing of the image forming unit.

2. The color image forming apparatus according to claim 1, wherein the drive speed control unit outputs a compensated count of system clocks based on the phase error from the phase error measurement unit, the compensated count being determined by inserting a count of system clocks corresponding to the phase error into a previous count of system clocks before the phase error measurement is started.

3. The color image forming apparatus according to claim 2, wherein the drive speed control unit outputs a compensated count of system clocks n times, the compensated count being determined by inserting 1/n of the second count of system clocks into the first count of system clocks where n is an integer equal to or larger than 1.

4. The color image forming apparatus according to claim 1, wherein the phase error measurement unit includes a phase error counter and a count control unit connected to the phase error counter, the phase error counter outputting a count of system clocks corresponding to the phase error.

5. The color image forming apparatus according to claim 1, further comprising a pulse width setting unit including a first register for receiving a count of system clocks corresponding to the phase error from the phase error measurement unit, and a second register for receiving a compensated count of system clocks based on the phase error measurement.

6. The color image forming apparatus according to claim 1, wherein the phase error measurement unit includes a phase error counter which starts counting system clocks at a rising edge of the reference mark signal and ends the counting of the system clocks at a rising edge of the line sync signal.

7. The color image forming apparatus according to claim 1, wherein the image forming unit includes a laser scan unit, the laser scan unit scanning the first image support in a main scan direction by a laser beam which is turned ON/OFF depending on an image signal, the laser scan unit outputting a line sync signal every time the scanning of the first image support is started.

8. The color image forming apparatus according to claim 1, wherein the image forming unit includes a photoconductive medium and an intermediate transfer belt, the photoconductive medium serving as the first image support, the intermediate transfer belt serving as the second image support.

* * * * *